US006232058B1

(12) United States Patent
Adin et al.

(10) Patent No.: US 6,232,058 B1
(45) Date of Patent: May 15, 2001

(54) HIGH-SPEED HIGH QUALITY DIRECT RADIOGRAPHIC FILM

(75) Inventors: Anthony Adin, Rochester; Richard E. Beal, Ontario; Franklin C. Brayer, Rochester; Catherine C. Wideman, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/480,404

(22) Filed: Jan. 11, 2000

(51) Int. Cl.[7] ..... G03C 1/08; G03C 7/26; G03C 7/32

(52) U.S. Cl. ..... 430/567; 430/966; 430/502; 430/606

(58) Field of Search ..... 430/966, 567, 430/606, 502

(56) References Cited

U.S. PATENT DOCUMENTS

| | | | | |
|---|---|---|---|---|
| 4,480,024 | | 10/1984 | Lyons et al. . | |
| 4,707,435 | | 11/1987 | Lyons et al. . | |
| 5,370,977 | | 12/1994 | Zietlow . | |
| 5,738,979 | | 4/1998 | Fitterman et al. . | |
| 5,866,309 | | 2/1999 | Fitterman et al. . | |
| 5,871,890 | | 2/1999 | Fitterman et al. . | |
| 5,876,909 | * | 3/1999 | Hershey et al. | 430/567 |
| 5,935,770 | | 8/1999 | Fitterman et al. . | |
| 5,942,378 | | 8/1999 | Fitterman et al. . | |
| 5,952,147 | * | 9/1999 | Dickerson et al. | 430/966 |
| 6,042,986 | * | 9/1999 | Dickerson et al. | 430/966 |

* cited by examiner

*Primary Examiner*—Geraldine Letscher
(74) *Attorney, Agent, or Firm*—L. Lanny Tucker

(57) ABSTRACT

A high quality direct radiographic film is useful for dental care. The film contains relatively high silver coverage preferably coated on both sides of the support. It also contains sufficient silver halide desensitizer to reduce silver halide sensitivity to X-radiation by at least 0.02 log E. The combination of silver and desensitizer coverages provides sufficiently high photographic speed, excellent image quality and increased stability to background radiation sources.

22 Claims, No Drawings

HIGH-SPEED HIGH QUALITY DIRECT RADIOGRAPHIC FILM

FIELD OF THE INVENTION

The present invention is directed to high-speed direct radiographic films useful as dental films. These films also have high stability to background radiation. This invention is useful in the field of radiography.

BACKGROUND OF THE INVENTION

Roentgen discovered X-radiation by the inadvertent exposure of a silver halide photographic element. In 1913, Eastman Kodak Company introduced its first product specifically intended to be exposed by X-radiation (X-rays). Silver halide radiographic films account for the overwhelming majority of medical diagnostic images. It was recognized almost immediately that the high energy ionizing X-rays are potentially harmful, and ways have been sought to avoid high levels of patient exposure. Radiographic films provide viewable silver images upon imagewise exposure followed by wet processing.

One approach, still in widespread practice is to coat a silver halide emulsion useful in radiographic films on both sides of the film support. Thus, the number of X-rays that can be absorbed and used for imaging are doubled, providing high sensitivity (that is, speed). Dual-coated radiographic films are sold by Eastman Kodak Company and other companies for various uses. Films that rely entirely on X-radiation absorption for image capture are referred to in the art as "direct" radiographic elements, while those that rely on fluorescent intensifying screens are referred to as "indirect" radiographic elements.

Direct radiographic elements have various uses, such as in industrial applications where intensifying screens cannot be used for some reason (for example, pipeline welds and turbine blades).

Another important application for direct radiographic elements is in dentistry where images of a patient's teeth and gums are made in order to provide desired diagnostic and preventive dental care. In dental diagnostic imaging a small piece of X-ray film (commonly referred to as a "chip") sealed in an opaque package is placed in a patient's mouth during X-ray exposure.

Due to the strongly penetrating nature of X-radiation, high quality direct radiographic elements (such as dental films) are generally comprised of a high coverage of silver on both sides of a flexible transparent film support. Various types of silver halide emulsions can be used in such films. Useful tabular grain silver halide emulsions for dental films are described in U.S. Pat. No. 5,370,977 (Zietlow).

Such films also generally contain one or more silver halide desensitizers to allow longer exposures of the high coverage, silver halide emulsions to safelights during handling and processing. Desensitizers are generally considered to be molecules having reduction potentials more positive than −0.9 volts versus a saturated Ag/AgCl electrode. Examples of desensitizers include dyes (for example cyanine and styryl dyes), nitro compounds and viologens. Electron-trapping dopants such as rhodium compounds and nitrosyl complexes of transition metal ions can also be used as silver halide desensitizers. Thus, desensitizers are useful for increasing safelight handling without affecting photographic speed for direct X-ray exposure.

A generally high silver coverage in high quality dental films minimizes patient and operator exposure to X-radiation by increasing photographic sensitivity. "High" silver coverage is meant to be generally from 12 to 22 g/m$^2$. However, this high silver coverage also makes the films very sensitive to background radiation (radiation from terrestrial and cosmic sources) that is usually the main source of fogging before the films are even used. That is, the films have lower than desirable stability to storage fogging. For example, a commercial dental film marketed as KODAK EKTASPEED PLUS Dental Film by Eastman Kodak Company contains high silver halide coverage for improved photographic speed and image quality. It also contains a moderate amount of a silver halide desensitizer, Pinacryptol Yellow {6-ethoxy-1-methyl-2-[2-(3-nitrophenyl)ethenyl] quinolinium methyl sulfate} sufficient to improve safelight handleability but not enough to cause significant speed loss upon X-ray exposure. While this product has desirable photographic speed, there is a desire to provide improved speed without decreasing stability to background radiation.

Direct X-ray exposure films of lower cost and image quality can be made by providing reduced silver halide coverage in the silver halide emulsion layers.

Copending and commonly assigned U.S. Ser. No. 09/334,310 (filed Jun. 16, 1999 by Dickerson) describes "low silver" dental films having lower cost without undesirable loss in photographic speed. Silver halide "desensitizers" (for example, 6-chloro-4-nitrobenzotriazole) can be used in such films at low amounts because fog formation is reduced with the lower silver halide coverage. This application has been abandoned in favor of Continuation-in-part application U.S. Ser. No. 09/604,032 (filed Jun. 27, 2000 by Dickerson).

For these reasons it has been difficult to provide high quality dental films that simultaneously have high sensitometric speed, safelight handleability, low graininess and stability to fogging during storage. Formulating a film having all of these desirable properties is not simply mixing the components that increase each property since some of those components work in opposition. Thus, there continues to be a need in the art for such high quality direct radiographic films (especially for dental films) that have all of the noted properties.

SUMMARY OF THE INVENTION

The problems noted above are overcome with the present invention.

More specifically, the present invention provides a direct radiographic film comprising a support and having disposed on at least one side thereof, a silver halide emulsion unit, the silver coverage in the silver halide unit being at least 7 g/m$^2$ and the silver halide unit comprises silver halide grains having at least 80 mol % bromide (based on total silver), no more than 3 mol % iodide (based on total silver), and a mean equivalent circular diameter of at least 0.8 $\mu$m, the silver halide emulsion unit further comprising a silver halide desensitizer sufficient to reduce sensitivity of the silver halide grains to X-radiation by at least 0.02 log E.

The combination of features in this direct radiographic film provides desired high photographic speed and high quality images while its stability to environmental radiation sources (that is, cosmic and terrestrial sources) is increased. Thus, fogging upon storage is reduced in the film, its sensitivity remains high and it can be handled under safelights for an acceptable time.

DETAILED DESCRIPTION OF THE INVENTION

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as the standard deviation (a) of grain ECD divided by the mean grain ECD.

The term "tabular grain" is used to define a silver halide grain having two parallel crystal faces that are clearly larger than any remaining crystal faces and having as aspect ratio of at least 2.

The term "front" and "back" refer to locations nearer to and further from, respectively, the source of X-radiation than the support of the film.

The term "dual-coated" is used to define a radiographic film having silver halide emulsion units disposed on both the front and back sides of the support.

The direct radiographic films of this invention include a flexible support having disposed on at least one side thereof: one or more silver halide emulsion units, each unit comprising one or more silver halide emulsion layers, and optionally one or more non-radiation sensitive hydrophilic layer(s). In preferred embodiments, the film has one or more of the same or different silver halide emulsions units on both sides of the support. Such preferred embodiments also have a protective overcoat over the silver halide emulsion units on each side of the support. The support can take the form of any conventional radiographic element support that is X-radiation and light transmissive.

In the more preferred embodiments, each silver halide emulsion unit can contain two or more layers, with at least one of these layers being a silver halide emulsion layer. For example, each silver halide emulsion unit can be divided into two or more silver halide emulsion layers of the same or different composition or thickness. In a most preferred form, each silver halide emulsion unit is comprised of one or two silver halide emulsion layers (of the same or different composition or thickness) and a non-light sensitive hydrophilic layer The protective overcoat can be sub-divided into two or more individual layers. For example, protective overcoats can be sub-divided into surface overcoats and interlayers (between the overcoat and silver halide emulsion unit).

Useful supports for the direct X-ray films of this invention can be chosen from among those described in *Research Disclosure*, Item 38957, cited above, XV. Supports and *Research Disclosure*, Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

In most of the films of this invention, the support is a transparent film support. In its simplest possible form the transparent film support consists of a transparent film chosen to allow direct adhesion of the hydrophilic silver halide emulsion units. More commonly, the transparent film is itself hydrophobic and subbing layers are coated on the film to facilitate adhesion of the hydrophilic silver halide emulsion units. Typically the support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

The silver halide emulsion units useful in this invention contain one or more silver halide emulsion layers comprising one or more types of silver halide grains responsive to X-radiation. Silver halide grain compositions particularly contemplated include those having at least 80 mol % bromide (preferably at least 98 mol % bromide) based on total silver. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver) to facilitate more rapid processing. Preferably iodide is limited to no more than 2 mol % (based on total silver) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains are tabular grains.

In addition, different silver halide emulsion layers can have silver halide grains of the same or different morphologies. For cubic grains, the grains generally have an ECD of at least 0.8 $\mu$m and less than 3 $\mu$m (preferably from about 0.9 to about 1.4 $\mu$m). The useful ECD values for other non-tabular morphologies would be readily apparent to a skilled artisan in view of the useful ECD values provided for cubic and tabular grains.

Generally, the average ECD of tabular grains used in the films is greater than 0.9 $\mu$m and less than 4.0 $\mu$m, and preferably greater than 1 and less than 3 $\mu$m. Most preferred ECD values are from about 1.6 to about 2.4 $\mu$m. The average thickness of the tabular grains is generally at least 0.1 and no more than 0.3 $\mu$m, and preferably at least 0.12 and no more than 0.18 $\mu$m.

Preferably at least one silver halide emulsion unit, at least 50% (and preferably at least 80%) of the silver halide grain projected area is provided by tabular grains having an average aspect ratio greater than 4, and more preferably greater than 10. The remainder of the silver halide projected area is provided by silver halide grains having one or more non-tabular morphologies.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al), U.S. Pat. No. 4,425,426 (Abbott et al), U.S. Pat. No. 4,439,520 (Kofron et al), U.S. Pat. No. 4,434,226 (Wilgus et al), U.S. Pat. No. 4,435,501 (Maskasky), U.S. Pat. No. 4,713,320 (Maskasky), U.S. Pat. No. 4,803,150 (Dickerson et al), U.S. Pat. No. 4,900,355 (Dickerson et al), U.S. Pat. No. 4,994,355 (Dickerson et al), U.S. Pat. No. 4,997,750 (Dickerson et al), U.S. Pat. No. 5,021,327 (Bunch et al), U.S. Pat. No. 5,147,771 (Tsaur et al), U.S. Pat. No. 5,147,772 (Tsaur et al), U.S. Pat. No. 5,147,773 (Tsaur et al), U.S. Pat. No. 5,171,659 (Tsaur et al), U.S. Pat. No. 5,252,442 (Dickerson et al), U.S. Pat. No. 5,370,977 (Zietlow), U.S. Pat. No. 5,391,469 (Dickerson), U.S. Pat. No. 5,399,470 (Dickerson et al), U.S. Pat. No. 5,411,853 (Maskasky), U.S. Pat. No. 5,418,125 (Maskasky), U.S. Pat. No. 5,494,789 (Daubendiek et al), U.S. Pat. No. 5,503,970 (Olm et al), U.S. Pat. No. 5,536,632 (Wen et al), U.S. Pat. No. 5,518,872 (King et al), U.S. Pat. No. 5,567,580

(Fenton et al), U.S. Pat. No. 5,573,902 (Daubendiek et al), U.S. Pat. No. 5,576,156 (Dickerson), U.S. Pat. No. 5,576,168 (Daubendiek et al), U.S. Pat. No. 5,576,171 (Olm et al), and U.S. Pat. No. 5,582,965 (Deaton et al). The patents to Abbott et al, Fenton et al, Dickerson and Dickerson et al are also cited and incorporated herein to show conventional element features in addition to gelatino-vehicle, high bromide (≧80 mol % bromide) tabular grain emulsions and other features of the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 36544, cited above, Section I. Emulsion grains and their preparation, sub-section D. Grain modifying conditions and adjustments, paragraphs (3), (4) and (5).

Low COV emulsions can be selected from among those prepared by conventional batch double-jet precipitation techniques. A general summary of silver halide emulsions and their preparation is provided by *Research Disclosure*, Item 36544, cited above, Section I. Emulsion grains and their preparation. After precipitation and before chemical sensitization the emulsions can be washed by any convenient conventional technique using techniques disclosed by *Research Disclosure*, Item 36544, cited above, Section III. Emulsion washing.

The emulsions can be chemically sensitized by any convenient conventional technique as illustrated by *Research Disclosure*, Item 36544, Section IV. Chemical Sensitization. Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 36544, Section VII. Antifoggants and stabilizers, and Item 18431, Section II. Emulsion Stabilizers, Antifoggants and Antikinking Agents.

The silver halide emulsion and other layers forming the silver halide emulsion units on opposite sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 36544, Section II. Vehicles, vehicle extenders, vehicle-like addenda and vehicle related addenda. The emulsions themselves can contain peptizers of the type set out in Section II. (noted above) paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsions in the radiographic films of this invention are generally fully hardened using a conventional hardener. Thus, the amount of hardener in each silver halide emulsion unit is generally at least 0.4% and preferably at least 0.6%, based on the total dry weight of the polymer vehicle.

Conventional hardeners can be used for this purpose, including formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

In each silver halide emulsion unit in the radiographic film, the level of silver is generally at least 7 and no more than 12 g/m$^2$, and preferably at least 8 and no more than 11 g/m$^2$. In addition, the total coverage of polymer vehicle is generally at least 4 and no more than 10 g/m$^2$, and preferably at least 5 and no more than 8 g/m$^2$. The amounts of silver and polymer vehicle on the two sides of the support can be the same or different. These amounts refer to dry weights.

One or more silver halide emulsion units in the films of this invention comprise one or more silver halide desensitizers in sufficient amounts to reduce the sensitivity of the silver halide grains to X-radiation by at least 0.021 og E (preferably from about 0.02 logE to about 0.05 log E).

A silver halide desensitizer is a compound that has a reduction potential more positive than −0.9 volts with reference to a saturated Ag/AgCl electrode that is adsorbed to the surface of silver halide emulsion grains.

To achieve this essential effect, the amount of desensitizer can be varied depending upon the type of silver halide emulsion, the particular desensitizer and the particular silver halide emulsion chemical sensitization. In most cases, the amount of desensitizer in each silver halide emulsion unit is at least 1 mg/mol of silver.

There are a wide variety of silver halide desensitizers known in the art. Conventional silver halide desensitizers do not reduce the absorption of X-rays, and at levels that reduce the sensitivity to light by a factor of 3 or more to improve safelight handleability, they do not reduce the sensitivity of the emulsions to X-rays. Conventional silver halide desensitizers that are not dyes are described for example in *Research Disclosure*, publication 38957, Section IV, subsection B. Examples of such compounds include, but are not limited to, N,N'dialkyl-4,4'-bispyridinium salts, nitron and its salts, thiouram disulfide, nitro-1,2,3-benzotriazole and nitroindazoles as described in U.S. Pat. No. 2,271,229 (Peterson et al), U.S. Pat. No. 2,541,472 (Kendall et al), U.S. Pat. No. 3,295,976 (Abbott et al), U.S. Pat. No. 3,184,313 (Rees et al), U.S. Pat. No. 3,403,025 (Rees et al), U.S. Pat. No. 3,922,545 (Biggons et al), U.S. Pat. No. 4,666,827 (Sumi et al) and U.S. Pat. No. 4,840,889 (Ueasawa et al), all incorporated herein by reference.

There are also silver halide desensitizers that are dyes [such as methine dyes (including cyanine and merocyanine dyes)] having one or more desensitizing nuclei. Typical heterocyclic nuclei suitable for use in cyanine and merocyanine dyes are derived from nitrobenzothiazole, 2-aryl-1-alkylindole, pyrrolo[2,3-b]pyridine, imidazo[4,5-b]quinoxaline, carbazole, pyrazole, 5-nitro-3H-indole, 2-arylbenzindole, 2-aryl-1,8-trimethyleneindole, 2-heterocycylindole, pyrylium, benzopyrylium, thiapyrylium, 2-amino-4-aryl-5-thiazole, 2-pyrrole, 2-(nitroaryl)indole, imidazo[1,2,a]pyridine, imidazo[2,1-b]-1,3,4-thiadiazole, imidazo[2,1-b]thiazole, imidazo[2,1-b]-1,3,4-thiazole, imidazo[1,2-b]pyridazine, imidazo[4,5-b]quinoxaline, pyrrolo[2,3-b]quinoxaline, pyrrolo[2,3-b]pyrazine, 1,2-diarylindole, 1-cyclohexylpyrrole and nitrobenzoselenazole. Such nuclei can be further enhanced in the desensitizing function by having electron-withdrawing substituents such as nitro, acetyl, benzoyl, sulfonyl, benzosulfonyl and cyano groups. Such desensitizing compounds are described for example in U.S. Pat. No. 2,293,261 (Kendall et al), U.S. Pat. No. 2,930,694 (Coenen et al), U.S. Pat. No. 3,431,111 (Brooker et al), U.S. Pat. No. 3,492,123 (Mee et al), U.S. Pat. No. 3,501,312 (Mee et al), U.S. Pat. No. 3,598,595 (Mee et al), U.S. Pat. No. 3,501,310 (Illingsworth et al), U.S. Pat. No. 3,501,311 (Lincoln et al), U.S. Pat. No. 3,615,608 (VanLare), U.S. Pat. No. 3,615,639 (Carpenter et al), U.S. Pat. No. 3,567,456 (Riester et al), U.S. Pat. No. 3,574,629 (Jenkins et al), U.S. Pat. No. 3,567,345 (Jones et al), U.S. Pat. No. 3,582,343 (Mee), U.S. Pat. No. 3,592,653 (Fumia et al), and U.S. Pat. No. 3,598,596 (Chapman et al), all incorporated herein by reference.

Alternatively, various dopants added to silver halide grains can also act as desensitizers. Such dopants include, but are not limited to, compounds capable of trapping an electron for at least one day. Particularly useful dopants include compounds of the formula $Rh(III)X_nH_2O_{6-n}$ wherein n is 3 to 6 (preferably 4 to 6), and X is a halide (such as chloride, bromide or iodide) or cyanide. Other useful dopants include compounds defined by the formula $M(NO)X_5$ wherein X is halide as noted above and M is osmium, iridium, cobalt, rhenium or ruthenium. Representative dopant desensitizers include, but are not limited to, water-soluble rhodium, iridium, ruthenium, osmium, rhenium and cobalt salts, all of which are well known in the art, for example in U.S. Pat. No. 4,933,272 (McDugle et al), incorporated herein by reference.

A preferred silver halide desensitizer is 6-ethoxy-1-methyl-2-[2-(3-nitrophenyl)ethenyl]quinolinium methyl sulfate (sometimes known as Pinacryptol Yellow).

The radiographic films generally include a surface protective overcoat on each side of the support that is typically provided for physical protection of the emulsion layers. In addition to vehicle features discussed above the protective overcoats can contain various addenda to modify the physical properties of the overcoats. Such addenda are illustrated by *Research Disclosure*, Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can include a blue toning dye or a tetraazaindene (such as 4-hydroxy-6-methyl-1,3,3a,7-tetraazaindene).

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layer and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions. The protective overcoats can include the features disclosed by *Research Disclosure*, Item 18431, cited above, IV. Overcoat Layers, and can also include addenda (including coating aids, plasticizers and lubricants, antistats and matting agents) disclosed by *Research Disclosure*, Item 38957, IX. Coating physical property modifying addenda.

The various coated layers of radiographic films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

The radiographic films of this invention can also be modified so that they can be handled in ambient light. For example, the films can include light-absorbing dyes that can be decolorized during wet processing. The dye particles provide an average density of greater than 3.0 over a spectral range of above 320 nm (particularly from 320 to 540 nm) over which the silver halide exhibits an absorption coefficient of at least 0.5 $cm^{-1}$. These dyes can be located in a silver halide emulsion layer or in a protective layer located between a silver halide emulsion layer and the source of actinic radiation. They may be located on both sides of the support if desired. It is particularly useful to use particulate dyes that serve this purpose. The noted copending applications describe a variety of such useful dyes and the typical processing solutions that can be used to decolorize them.

Preferred embodiments of the present invention comprise a direct radiographic film comprising a light transmissive support and having disposed on each side thereof, a silver halide emulsion unit, the silver coverage in each silver halide emulsion unit being from about 8 to about 11 $g/m^2$ and each silver halide emulsion unit comprises tabular silver halide grains having at least 98 mol % bromide (based on total silver), no more than 2 mol % iodide (based on total silver), and a mean equivalent circular diameter of from about 1 to about 3 $\mu$m, each silver halide emulsion unit further comprising one or more silver halide emulsion layers, at least one of the silver halide emulsion layers comprising as a silver halide desensitizer, 6-ethoxy-1-methyl-2-[2-(3-nitrophenyl)ethenyl]-quinolinium methyl sulfate, that is present in an amount sufficient to reduce sensitivity of the silver halide grains to X-radiation by from about 0.021 ogE to about 0.05 og E, the film further comprising an overcoat disposed on each silver halide emulsion unit, the film also comprising in either or both the overcoats or a silver halide emulsion layer in each silver halide emulsion unit, a non-bleachable tinting dye, the film exhibiting fog growth of less than 0.18 (±0.04) upon exposure to 200 mR of either $Co^{60}$ or $Ir^{192}$ radiation.

Exposure and processing of the direct X-ray films of the invention can be undertaken in any convenient conventional manner. The exposure and processing techniques of U.S. Pat. No. 5,370,977 (noted above), are typical for processing dental direct X-ray films. The exposure and processing techniques of U.S. Pat. No. 4,480,024 (Lyons et al) and U.S. Pat. No. 4,707,435 (Lyons et al), incorporated herein by reference, are typical for processing industrial direct X-ray films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference.

The following examples are provided for illustrative purposes, and are not meant to be limiting in any way.

EXAMPLE 1

Films of the present invention were prepared with the following layers and compositions coated on one side of a clear poly(ethylene terephthalate) film support (178 μm thickness):

| Protective Overcoat: | |
|---|---|
| Gelatin | 0.89 g/m$^2$ |
| TRITON X-200 surfactant | 0.09 g/m$^2$ |

Silver Halide Emulsion Layer:

AgBr tabular grain emulsion in which tabular grains accounted for greater than 50 percent of total grain projected area. The mean grain ECD (μm) and the mean thickness of the tabular grains (x μm) for the various emulsions are shown in TABLE I below. The "BWM" latex polymer was poly(n-butyl acrylate-co-2-acrylamido-2-methylpropane sulfonic acid-co-acetoacetoxyethyl methacrylate) (90:4:6 weight ratio). "Acetamido PMT" is 1-(3-acetamido-phenyl-5-mercapto)tetrazole. "TAI" is 4-hydroxy-6-methyl-1,3,3a,7-tetraazaindene.

| | |
|---|---|
| Silver bromide | 9 g Ag/m$^2$ |
| Gelatin | 4.5 g/m$^2$ |
| Dextran P | 1.5 g/m$^2$ |
| BWM latex polymer | 1.5 g/m$^2$ |
| Sorbitol | 0.15 g/m$^2$ |
| TAI | 2 g/Ag mole |
| 3,5-Disulfocatechol disodium salt | 1 g/Ag mole |
| Acetamido PMT | 0.15 g/m$^2$ |
| Glycerin | 0.15 g/m$^2$ |
| Resorcinol | 0.18 g/m$^2$ |
| Sodium bromide | 0.4 g/Ag mole |
| Sulfuric acid | 0.1 g/Ag mole |

-continued

| | |
|---|---|
| TRITON X-200 surfactant | 0.1 g/m$^2$ |
| 10G surfactant | 0.019 g/m$^2$ |

The protective overcoat and silver halide emulsion layer were hardened by adding to each silver halide emulsion layer bis(vinylsulfonylmethyl)ether hardener in a concentration of 2.2%, based on the total gelatin weight in both the silver halide emulsion layer and the protective overcoat.

Chemical Sensitization:

The AgBr emulsion was chemically sensitized using the following chemicals, bracketed amounts are in units of mg/Ag mole: 4,4'-phenyl disulfide diacetanilide [0.5], potassium tetrachloroaurate [2.8], sodium thiocyanate [150], anhydro-5,6-dimethoxy-3-(3-sulfopropyl)benzothiazolium inner salt [15], sodium thiosulfate pentahydrate [2.3], and potassium selenocyanate [0.23].

Chemical sensitization was accomplished by adding these chemicals in sequential order at 40° C., heating to 60° C. at a rate of 1.67° C./minute, held at 60° C. for 10 minutes, and then cooled to 40° C. at 1.67° C./minute. After this procedure, various levels (mg/Ag mole) of a preferred desensitizer, Pinacryptol Yellow, were added to some of the emulsion samples. The silver halide emulsions were then chilled rapidly with stirring until chill set.

The emulsion used in Film 3 (noted below) was doped during emulsion precipitation as described below. The emulsions used in Films 1 and 2 were not doped in this manner.

The resulting films were submitted to the following tests:

a) Exposures (0.01 second) to blue light using a Wratten 39 filter, a 2850K tungsten source and a carbon step tablet. Processing was carried out using a commercially available KODAK RP X-OMAT Processor M6A-N (extended cycle), conditions and processing solutions designed for it. Photographic speed was measured at 1.0 density above fog and is expressed in logE units. Higher speed is predictive of safelight sensitivity.

b) Direct X-ray exposures (80 kV) modulated with an aluminum stepwedge. This gives a measure of photographic film speed in practical use. Speed was measured at 0.85 above fog and expressed in logE units. The exposed films were processed for 5 minutes at 20° C. in commercially available GBX black-and-white developing solution.

c) Exposure (200 mR) to $Co^{60}$ or $Ir^{192}$ radiation to simulate the effect of naturally occurring background radiation (from cosmic rays and terrestrial radioactivity). This exposure is considered a good predictor for fog increases resulting from natural keeping of dental films in most locations. The increase in film fog was measured following each exposure. The exposed films were processed as in b).

The results are summarized in the following TABLE I:

TABLE I

| FILM/ EMULSION | GRAIN SIZE | PINA-CRYPTOL YELLOW | X-RAY SPEED | BLUE SPEED | $Co^{60}$ FOG GROWTH |
|---|---|---|---|---|---|
| 1 | 1.6 × 0.145 | 0 | 2.17 | 2.32 | 0.13 |
| " | " | 4 | 2.19 | 1.80 | 0.14 |
| " | " | 16 | 2.14 | 1.22 | 0.07 |
| 2 | 1.9 × 0.125 | 0 | 2.30 | 2.28 | 0.19 |
| " | " | 4 | 2.32 | 1.75 | 0.19 |
| " | " | 9 | 2.28 | 1.27 | 0.10 |
| 3 | 1.9 × 0.129 | 0 | 2.28 | 1.27 | 0.10 |
| " | " | 4 | 2.26 | 1.13 | 0.08 |

As shown in TABLE I above, for Film 1 the lowest amount of silver halide desensitizer (Pinacryptol Yellow) significantly decreased light sensitivity, which is predictive of improved safelight sensitivity (handleability) without decreasing X-ray speed. The sensitivity to $Co^{60}$ radiation however was not decreased. When the desensitizer level was increased to 16 mg/Ag mole there was a slight (0.03 logE) drop in X-ray speed but the sensitivity to $Co^{60}$ radiation was reduced by about 50%.

Film 2 containing larger silver halide grains exhibited higher X-ray speed, but was also sensitive to more fogging from $Co^{60}$ radiation exposure. The lowest amount of desensitizer decreased light (blue) sensitivity without decreasing X-ray speed, but the fogging from exposure to $Co^{60}$ was not reduced. Increasing the desensitizer level to 9 mg/Ag mole caused a X-ray speed loss (0.02 logE) compared to the Film 2 without desensitizer, but at the same time predicted background radiation sensitivity was reduced by more than 30%. Moreover, at this desensitizer level the radiation sensitivity of Films 1 and 2 were comparable but Film 2 was 0.10 logE faster with practical direct X-ray exposures. This demonstrates that specific silver halide emulsion grain sizes and desensitizer levels can be appropriately used in combination to provide films with very high practical speeds and unusually low sensitivity to background radiation.

Film 3 contained an emulsion identical to that of Film 2 (without Pinacryptol Yellow) except the emulsion was doped with ammonium hexachlororhodate during emulsion precipitation. This dopant acted as a silver halide desensitizer. Emulsions in Films 1 and 2 were not doped in this manner.

Film 3 without Pinacryptol Yellow provided the same photographic speed as Film 2 containing 9 mg/Ag mole of Pinacryptol Yellow, and demonstrates that dopant desensitizers can be used to provide high X-ray exposure speed and surprisingly low background radiation sensitivity. As shown in the last line of TABLE I, the addition of Pinacryptol Yellow can be added to further reduce predicted sensitivity to background radiation while there was only a slight 0.02 logE X-ray speed loss. This demonstrates that a combination of various silver halide desensitizers can be used in combination to achieve the unexpected results described herein.

EXAMPLE 2

Films of the present invention were prepared with the following layers and compositions coated on one side of a poly(ethylene terephthalate) film support (178 $\mu$m thickness):

| Protective Overcoat: | |
|---|---|
| Gelatin | 0.89 g/m$^2$ |
| TRITON X-200 surfactant | 0.09 g/m$^2$ |

| Silver Halide Emulsion Layer: | |
|---|---|
| $AgI_{1.7}Br_{98.3}$ (1.0 $\mu$m spheres) | 10.4 g Ag/m$^2$ |
| Gelatin | 4.5 g/m$^2$ |
| Dextran P | 1.5 g/m$^2$ |
| Sorbitol | 0.15 g/m$^2$ |
| TAI | 1.5 g/Ag mole |
| 3,5-Disulfocatechol disodium salt | 1 g/Ag mole |
| Glycerin | 0.15 g/m$^2$ |
| Resorcinol | 0.18 g/m$^2$ |
| Sodium bromide | 0.88 g/Ag mole |
| Nitron | 0.0065 g/m$^2$ |
| Sulfuric acid | 0.3 g/Ag mole |

-continued

| Silver Halide Emulsion Layer: | |
|---|---|
| TRITON X-200 surfactant | 0.1 g/m$^2$ |
| 10G surfactant | 0.019 g/m$^2$ |

The protective overcoat and silver halide emulsion layer were hardened by adding to each silver halide emulsion layer bis(vinylsulfonylmethyl)ether hardener in a concentration of 0.8%, based on the total gelatin weight in both the silver halide emulsion layer and the protective overcoat.

Chemical Sensitization:

The AgBrI emulsion was chemically sensitized using the following chemicals, bracketed amounts are in units of mg/Ag mole: sodium tetrachloroaurate [0.8], sodium thiosulfate pentahydrate [6], and 3-methyl-1,3-benzothiazolium iodide [6].

Chemical sensitization was accomplished by adding these chemicals in sequential order at 40° C., heating to 63° C. over 15 minutes, held for 5 minutes, and then cooled to 40° C. over 15 minutes. After this procedure, various levels (mg/Ag mole) of a preferred desensitizer, Pinacryptol Yellow, were added to the emulsion samples. The silver halide emulsions were then chilled rapidly with stirring until chill set.

The resulting films were submitted to the exposure tests described in Example 1 except that the light exposure was increased to 0.04 seconds and the processing for test b) was carried out using a commercially available Air Techniques AT-2000 processing containing commercially available Readymatic processing chemistry that is also described in U.S. Pat. No. 5,370,977.

The results are summarized in the following TABLE II:

TABLE II

| FILM/ EMULSION | PINACRYPTOL YELLOW | X-RAY SPEED | BLUE SPEED | $Co^{60}$ FOG GROWTH |
|---|---|---|---|---|
| 4 | 3 | 2.07 | 1.87 | 0.080 |
| " | 6 | 2.07 | 1.69 | 0.080 |
| " | 10 | 2.02 | 1.34 | 0.051 |

As shown in TABLE II above, emulsions containing 3 and 6 mg/Ag mole of Pinacryptol Yellow desensitizer provided identical X-ray speeds and background radiation sensitivities with progressively lower light sensitivities. Further increasing the desensitizer level provided a large improvement (36%) in predicted background radiation insensitivity and a smaller (0.05 logE) loss in practical X-ray speed.

EXAMPLE 3

Films of the present invention were prepared with the following layers and compositions coated on each side of a clear poly(ethylene terephthalate) film support (178 $\mu$m thickness):

| Protective Overcoat: | |
|---|---|
| Gelatin | 0.89 g/m$^2$ |
| Poly(methyl methacrylate) beads | 0.05 g/m$^2$ |
| TAI | 0.011 g/m$^2$ |
| 1,4-bis(2,6-diethylpheyl)amino-9,10-anthracenedione (dispersed in tricresyl phosphate | 0.005 g/m$^2$ |

-continued

| Protective Overcoat: | |
|---|---|
| LODYNE S-100 surfactant | 0.005 g/m$^2$ |
| TRITON X-200 surfactant | 0.013 g/m$^2$ |

| Silver Halide Emulsion Layer: | |
|---|---|
| AgBr tabular grains | 9.15 g Ag/m$^2$ |
| Gelatin | 4.9 g/m$^2$ |
| Dextran P | 1.5 g/m$^2$ |
| Sorbitol | 0.58 g/m$^2$ |
| TAI | 1.5 g/Ag mole |
| 2-Methylmercapto TAI | 0.1 g/Ag mole |
| 3,5-Disulfocatechol disodium salt | 3 g/Ag mole |
| Nitron | 0.0066 g/m$^2$ |
| Resorcinol | 0.18 g/m$^2$ |
| Sodium bromide | 0.99 g/Ag mole |
| Maleic acid hydrazide | 0.044 g/Ag mole |
| Sulfuric acid | 0.34 g/Ag mole |
| Acetamido PMT | 0.15 g/Ag mole |
| "GWN" polymer latex | 1.1 g/m$^2$ |
| TRITON X-200 surfactant | 0.1 g/m$^2$ |

"GWN" polymer latex is poly(N-butyl acrylate-co-styrene-co-methacrylamide-co-2-acrylamido-2-methylpropane sulfonic acid, sodium salt) (58.5:25:7.8:8.7 weight ratio).

Two AgBr tabular grain emulsions ("5" and "6") were used in these films. One emulsion had grains of the size 2.07 $\mu$m average diameter and 0.135 $\mu$m average thickness. The other had grains of the size 1.92 $\mu$m average diameter and 0.135 $\mu$m average thickness. Emulsion 5 contained 17 mg/Ag mole of the preferred silver halide desensitizer Pinacryptol Yellow, and Emulsion 6 contained 11 mg/Ag mole of the same desensitizer.

Chemical Sensitization:

The AgBr emulsions were chemically sensitized using the following chemicals, bracketed amounts are in units of mg/Ag mole: sodium tetrachloroaurate [2.3], p-glutaramidophenyl disulfide [1], 1,3-dicarboxymethyl-1,3-dimethyl-2-thiourea, disodium salt [2.4], sodium thiocyanate [150], anhydro-5,6-dimethoxy-3-(3-sulfopropyl) benzothiazolium [14], and potassium selenocyanate [0.3].

Chemical sensitization was accomplished by adding these chemicals in sequential order at 40° C., heating to 70° C. over 18 minutes, held for 10 minutes, and then cooled to 40° C. over 18 minutes. After this procedure, a preferred desensitizer, Pinacryptol Yellow, was added (mg/Ag mole) to the emulsion samples. The silver halide emulsions were then chilled rapidly with stirring until chill set. Both the protective overcoats and silver halide emulsion layers were hardened by adding to each silver halide emulsion layer bis(vinylsulfonylmethyl)ether hardener in a concentration of 2%, based on the total gelatin weight in both the silver halide emulsion layer and the protective overcoat on each side.

The resulting films were submitted to the X-ray and background radiation tests and processing as described in Example 1.

The results are summarized in the following TABLE III:

TABLE III

| FILM/ EMULSION | PINACRYPTOL YELLOW | X-RAY SPEED | $Ir^{192}$ FOG GROWTH |
|---|---|---|---|
| 5 | 17 | 2.65 | 0.18 |
| 6 | 11 | 2.64 | 0.24 |

As shown in TABLE III, the emulsions had virtually the same X-ray speed, but emulsion 5 demonstrated a predicted 25% reduction in sensitivity to background radiation. Direct X-ray exposed images of a phantom jawbone using these two films were indistinguishable from each other. This example shows that the present invention can be used to provide high quality, direct X-ray sensitive films have much improved resistance to fogging from background radiation.

The invention has been described in detail with particular reference to preferred embodiments thereof, but it will be understood that variations and modifications can be effected within the spirit and scope of the invention.

We claim:

1. A direct radiographic film comprising a support and having disposed on at least one side thereof, a silver halide emulsion unit, the silver coverage in said silver halide emulsion unit being at least 7 g/m$^2$ and said silver halide emulsion unit comprises silver halide grains that are sensitive to X-radiation and have at least 80 mol % bromide (based on total silver), no more than 3 mol % iodide (based on total silver), and a mean equivalent circular diameter of at least 0.8 $\mu$m, said silver halide emulsion unit further comprising a silver halide desensitizer in an amount sufficient to reduce sensitivity of said silver halide grains to X-radiation by from about 0.02 log E to about 0.05 log E.

2. The film of claim 1 wherein the silver coverage in said silver halide emulsion unit is from about 8 to about 11 g/m$^2$.

3. The film of claim 1 wherein less than 50% of the silver halide projected area in at least one silver halide emulsion unit is provided by tabular silver halide grains, and the remainder of said silver halide projected area is provided by silver halide grains having one or more non-tabular morphologies.

4. The film of claim 1 wherein at least 50% of the silver halide grain projected area in said silver halide emulsion unit is provided by tabular silver halide grains.

5. The film of claim 4 wherein at least 80% of the silver halide grain projected area in said silver halide emulsion unit is provided by tabular silver halide grains.

6. The film of claim 1 wherein said silver halide grains have a mean equivalent circular diameter (ECD) of from about 0.9 to about 4 $\mu$m.

7. The film of claim 1 wherein the silver halide grains in said silver halide emulsion unit comprise at least 98 mol % bromide (based on total silver).

8. The film of claim 7 wherein said silver halide desensitizer is a compound having a reduction potential more positive than −0.9 volts with reference to a saturated Ag/AgCl electrode, that is adsorbed to the surface of said silver halide emulsion grains.

9. The film of claim 1 wherein said silver halide desensitizer is a methine dye having one or more desensitizing nuclei.

10. The film of claim 1 wherein said silver halide desensitizer is a dopant capable of trapping an electron for at least one day.

11. The film of claim 10 wherein said silver halide desensitizer is a compound represented by the formula $Rh(III)X_nH_2O_{6-n}$ wherein n is 3 to 6 and X is a halide or cyanide.

12. The film of claim 10 wherein said silver halide desensitizer is a compound represented by the formula $M(NO)X_5$ wherein M is osmium, rhodium, iridium, cobalt, rhenium or ruthenium.

13. The film of claim 1 wherein said silver halide desensitizer is 6-ethoxy-1-methyl-2-[2-(3-nitrophenyl)ethenyl] quinolinium methyl sulfate.

14. The film of claim 1 wherein said silver halide emulsion unit comprises a sulfur, selenium or gold chemical sensitizer for said silver halide grains.

15. The film of claim 1 that exhibits fog growth of less than 0.18 (±0.04) upon exposure to 200 mR of either $Co^{60}$ or $Ir^{192}$ radiation.

16. The film of claim 1 wherein said silver halide emulsion unit further comprises a non-bleachable tinting dye.

17. The film of claim 1 further comprising an overcoat on each side of said support.

18. The film of claim 17 wherein said overcoat on at least one side of said support comprises 4-hydroxy-6-methyl-1, 3,3a,7-tetraazaindene, and a blue toning dye.

19. The film of claim 1 wherein said silver halide emulsion unit comprises at least 0.4% hardener based on total hydrophilic colloid in said silver halide emulsion unit.

20. The film of claim 1 further comprising a decolorizable light-absorbing dye.

21. The film of claim 1 comprising the same or different silver halide emulsion unit on each side of said support.

22. A direct radiographic film comprising a light transmissive support and having disposed on each side thereof, a silver halide emulsion unit, the silver coverage in each silver halide emulsion unit being from about 8 to about 11 $g/m^2$ and each silver halide emulsion unit comprises tabular silver halide grains having at least 98 mol % bromide (based on total silver), no more than 2 mol % iodide (based on total silver), and a mean equivalent circular diameter of from about 1 to about 3 $\mu$m, each silver halide emulsion unit further comprising one or more silver halide emulsion layers, at least one of said silver halide emulsion layers comprising as a silver halide desensitizer, 6-ethoxy-1-methyl-2-[2-(3-nitrophenyl)ethenyl]-quinolinium methyl sulfate, that is present in an amount sufficient to reduce sensitivity of said silver halide grains to X-radiation by from about 0.02 log E to about 0.05 log E, said film further comprising an overcoat disposed on each silver halide emulsion unit, said film also comprising in either or both said overcoats or a silver halide emulsion layer in each silver halide emulsion unit, a non-bleachable tinting dye, said film exhibiting fog growth of less than 0.18 (±0.04) upon exposure to 200 mR of either $Co^{60}$ or $Ir^{192}$ radiation.

* * * * *